US008272073B2

(12) United States Patent
Arensdorf et al.

(10) Patent No.: US 8,272,073 B2
(45) Date of Patent: Sep. 25, 2012

(54) ATHLETIC PROTECTIVE PADDING

(75) Inventors: Stephen C. Arensdorf, Mays, KS (US); Edward H. Tobergte, Hilton Head Island, SC (US)

(73) Assignee: Stromgren Athletics, Inc., Gardner, KS (US)

( * ) Notice: Subject to any disclaimer, the term of this patent is extended or adjusted under 35 U.S.C. 154(b) by 536 days.

(21) Appl. No.: 12/006,195

(22) Filed: Dec. 31, 2007

(65) Prior Publication Data

US 2008/0222766 A1 Sep. 18, 2008

Related U.S. Application Data

(63) Continuation-in-part of application No. 11/059,769, filed on Feb. 17, 2005, now abandoned.

(51) Int. Cl.
*A41D 27/26* (2006.01)
*A41D 1/08* (2006.01)

(52) U.S. Cl. ..... 2/267; 2/228

(58) Field of Classification Search ..... 2/455, 23, 2/466, 227, 228, 267, 403, 404, 405
See application file for complete search history.

(56) References Cited

U.S. PATENT DOCUMENTS

| | | | | |
|---|---|---|---|---|
| 58,403 | A | | 10/1866 | Goodwin |
| 357,597 | A | | 2/1887 | Hazelton |
| 386,191 | A | | 7/1888 | Ferris |
| 491,123 | A | | 2/1893 | McClure |
| 891,977 | A | | 6/1908 | Bloch |
| 901,592 | A | | 10/1908 | Clegg |
| 1,295,297 | A | | 2/1919 | French |
| 1,374,177 | A | | 4/1921 | Barry |
| 1,374,669 | A | | 4/1921 | McClellan |
| 1,389,767 | A | | 9/1921 | Ludwig |
| 1,406,794 | A | * | 2/1922 | Whitley ..... 2/23 |
| 1,483,881 | A | | 2/1924 | Hart |
| 1,514,462 | A | | 11/1924 | Ritter |
| 1,526,417 | A | | 2/1925 | Goldsmith |
| 1,573,212 | A | | 2/1926 | Whitley et al. |
| 1,587,508 | A | | 6/1926 | Coats |
| 1,602,454 | A | | 10/1926 | Riddell |
| 1,622,211 | A | | 3/1927 | Sheehan |
| 1,697,833 | A | | 1/1929 | Lane |
| 1,717,609 | A | | 6/1929 | Ludwig |
| 1,887,473 | A | | 11/1932 | Warner |
| 1,915,754 | A | | 6/1933 | O'Shea |
| 2,057,575 | A | | 10/1936 | Houghton |
| 2,165,081 | A | | 7/1939 | Wald |
| D123,025 | S | | 10/1940 | Colnes |
| 2,249,966 | A | | 7/1941 | Matthews |
| 2,251,018 | A | | 7/1941 | Lookabaugh |
| 2,266,886 | A | | 12/1941 | McCoy |
| 2,296,335 | A | | 9/1942 | Brady |
| 2,460,895 | A | | 2/1949 | Meany |
| 2,467,907 | A | | 4/1949 | Peckham |
| 2,539,170 | A | | 1/1951 | Waite et al. |
| 2,545,039 | A | | 3/1951 | Mitchel |
| 2,553,612 | A | | 5/1951 | Taylor |

(Continued)

*Primary Examiner* — Alissa L Hoey
(74) *Attorney, Agent, or Firm* — Erickson, Kernell, Derusseau & Kleypas, LLC

(57) ABSTRACT

An athletic protective pad having first and second layers of breathable fabric and a foam body having a layer of perforated foam. The layer of foam is preferably closed cell foam with spaced apart perforations therethrough. The foam body is sandwiched in a secure or permanent position between the first and second layers of fabric, thereby wicking moisture away from a wearer.

3 Claims, 6 Drawing Sheets

U.S. PATENT DOCUMENTS

| | | | | | |
|---|---|---|---|---|---|
| 2,570,497 | A | | 10/1951 | Senderowitz | |
| 2,629,094 | A | | 2/1953 | Goldsmith | |
| 2,640,993 | A | | 6/1953 | Kleinman | |
| 2,774,073 | A | | 12/1956 | Herbener | |
| 2,800,663 | A | | 7/1957 | Falk | |
| 2,853,757 | A | | 9/1958 | Rave | |
| 2,884,675 | A | | 5/1959 | Sternschuss | |
| 2,930,046 | A | | 3/1960 | Sagner | |
| 2,957,177 | A | | 10/1960 | Turner | |
| 3,044,075 | A | | 7/1962 | Rawlings | |
| 3,073,305 | A | | 1/1963 | Biggs, Jr. et al. | |
| 3,088,115 | A | | 5/1963 | Groot | |
| 3,125,762 | A | | 3/1964 | Glahe | |
| 3,144,657 | A | | 8/1964 | Groot | |
| 3,146,461 | A | | 9/1964 | Kavanagh | |
| 3,176,686 | A | | 4/1965 | Barnes | |
| 3,194,233 | A | | 7/1965 | Peckham | |
| 3,237,257 | A | | 3/1966 | Forsberg | |
| 3,248,738 | A | | 5/1966 | Morgan | |
| 3,295,530 | A | | 1/1967 | Mayer et al. | |
| 3,310,053 | A | | 3/1967 | Greenwood | |
| 3,350,719 | A | | 11/1967 | McClure, Jr. | |
| 3,407,452 | A | | 10/1968 | Abert et al. | |
| 3,431,560 | A | | 3/1969 | Austin | |
| 3,463,147 | A | | 8/1969 | Stubbs | |
| 3,484,868 | A | * | 12/1969 | Davenport, Jr. | 2/465 |
| 3,506,000 | A | | 4/1970 | Baker | |
| 3,515,142 | A | | 6/1970 | Black | |
| 3,528,412 | A | | 9/1970 | McDavid | |
| 3,581,741 | A | | 6/1971 | Rosman et al. | |
| 3,584,622 | A | | 6/1971 | Domenico | |
| 3,640,273 | A | | 2/1972 | Ray | |
| 3,674,023 | A | | 7/1972 | Mann | |
| 3,721,992 | A | | 3/1973 | Ettinger | |
| 3,739,397 | A | | 6/1973 | Truelove | |
| 3,740,762 | A | | 6/1973 | Truelove | |
| 3,787,892 | A | * | 1/1974 | Quinn | 2/466 |
| 3,799,158 | A | | 3/1974 | Gardner | |
| 3,885,252 | A | | 5/1975 | Nakajima | |
| 3,909,847 | A | | 10/1975 | Holt et al. | |
| 3,945,046 | A | | 3/1976 | Stromgren | |
| 4,097,932 | A | | 7/1978 | Lacey | |
| 4,136,226 | A | | 1/1979 | Gilman | |
| 4,166,460 | A | | 9/1979 | Applegate | |
| 4,179,826 | A | | 12/1979 | Davidson | |
| 4,237,874 | A | | 12/1980 | Nelson | |
| 4,249,524 | A | | 2/1981 | Anderson | |
| 4,256,097 | A | | 3/1981 | Willis | |
| 4,272,847 | A | | 6/1981 | Buhler | |
| 4,280,489 | A | | 7/1981 | Johnson, Jr. | |
| 4,287,920 | A | | 9/1981 | Johnson, Jr. | |
| 4,312,335 | A | | 1/1982 | Daniell, Jr. | |
| 4,325,148 | A | | 4/1982 | Livernois | |
| 4,367,733 | A | | 1/1983 | Stromgren | |
| 4,370,754 | A | | 2/1983 | Donzis | |
| 4,373,211 | A | | 2/1983 | Goudreau et al. | |
| 4,381,768 | A | | 5/1983 | Erichsen et al. | |
| 4,422,183 | A | | 12/1983 | Landi et al. | |
| 4,428,080 | A | | 1/1984 | Takamatsu | |
| 4,453,271 | A | | 6/1984 | Donzis | |
| 4,455,686 | A | | 6/1984 | Zide | |
| 4,462,115 | A | | 7/1984 | Carlson et al. | |
| 4,479,269 | A | | 10/1984 | Balliet | |
| 4,486,901 | A | | 12/1984 | Donzis | |
| D277,236 | S | | 1/1985 | Gregory | |
| 4,507,801 | A | * | 4/1985 | Kavanagh et al. | 2/462 |
| 4,513,449 | A | | 4/1985 | Donzis | |
| 4,554,681 | A | | 11/1985 | Kirkland | |
| 4,580,408 | A | | 4/1986 | Stuebner | |
| 4,590,622 | A | | 5/1986 | Wolfe et al. | |
| D286,946 | S | | 12/1986 | Parks et al. | |
| D287,181 | S | | 12/1986 | Parsons, Jr. | |
| 4,628,945 | A | | 12/1986 | Johnson, Jr. | |
| 4,670,945 | A | | 6/1987 | Banks | |
| 4,675,912 | A | | 6/1987 | Kirkland | |
| 4,691,697 | A | | 9/1987 | Arensdorf et al. | |
| 4,700,403 | A | | 10/1987 | Vacanti | |
| 4,700,407 | A | | 10/1987 | Mattila | |
| 4,727,863 | A | | 3/1988 | Nelson | |
| D296,595 | S | | 7/1988 | Flosi et al. | |
| 4,807,301 | A | | 2/1989 | Ferber | |
| D301,566 | S | | 6/1989 | Heiberger | |
| 4,844,058 | A | | 7/1989 | Vogelbach | |
| 4,868,925 | A | | 9/1989 | Mitchell | |
| 4,872,216 | A | | 10/1989 | Wingo, Jr. | |
| 4,878,274 | A | | 11/1989 | Patricy | |
| 4,894,867 | A | * | 1/1990 | Ceravolo et al. | 2/238 |
| 4,926,503 | A | | 5/1990 | Wingo | |
| 4,945,571 | A | | 8/1990 | Calvert | |
| 4,961,233 | A | | 10/1990 | Black | |
| 4,962,768 | A | | 10/1990 | Stromgren et al. | |
| 4,974,343 | A | | 12/1990 | Davidson | |
| 4,985,931 | A | | 1/1991 | Wingo | |
| 4,987,613 | A | * | 1/1991 | Loverdi et al. | 2/23 |
| 4,989,265 | A | | 2/1991 | Nipper et al. | |
| 4,993,076 | A | | 2/1991 | Dierickx | |
| 5,007,108 | A | | 4/1991 | Laberge et al. | |
| 5,007,416 | A | | 4/1991 | Burns et al. | |
| 5,010,596 | A | | 4/1991 | Brown et al. | |
| 5,020,156 | A | | 6/1991 | Neuhalfen | |
| 5,029,341 | A | | 7/1991 | Wingo, Jr. | |
| 5,046,197 | A | | 9/1991 | Chernuchin et al. | |
| 5,054,121 | A | | 10/1991 | Mitchell | |
| 5,060,314 | A | | 10/1991 | Lewis | |
| 5,105,473 | A | | 4/1992 | Valtakari | |
| 5,107,542 | A | | 4/1992 | Zide et al. | |
| 5,125,400 | A | | 6/1992 | Johnson, Jr. | |
| 5,133,093 | A | * | 7/1992 | Tsuchiya | 2/403 |
| 5,134,726 | A | * | 8/1992 | Ross | 2/465 |
| 5,159,715 | A | | 11/1992 | Jurga et al. | |
| 5,161,257 | A | | 11/1992 | Arensdorf et al. | |
| 5,168,576 | A | | 12/1992 | Krent et al. | |
| 5,172,494 | A | | 12/1992 | Davidson | |
| 5,173,964 | A | | 12/1992 | Ball et al. | |
| 5,187,812 | A | | 2/1993 | Neuhalfen | |
| 5,226,192 | A | | 7/1993 | Jones et al. | |
| D339,902 | S | | 10/1993 | Doherty | |
| 5,259,096 | A | | 11/1993 | Grant | |
| 5,319,806 | A | | 6/1994 | Hermann et al. | |
| 5,361,410 | A | | 11/1994 | Sigl | |
| 5,365,610 | A | * | 11/1994 | Lubahn et al. | 2/23 |
| 5,390,368 | A | | 2/1995 | Chang | |
| 5,423,087 | A | | 6/1995 | Krent et al. | |
| D360,516 | S | | 7/1995 | Persinger | |
| 5,437,613 | A | | 8/1995 | Reggio et al. | |
| 5,449,341 | A | | 9/1995 | Harris | |
| 5,487,187 | A | | 1/1996 | Zide et al. | |
| 5,492,133 | A | | 2/1996 | McVicker | |
| 5,493,736 | A | | 2/1996 | Allison | |
| 5,536,246 | A | | 7/1996 | Saunders | |
| 5,551,091 | A | | 9/1996 | Tyndall | |
| 5,557,802 | A | | 9/1996 | Wickert | |
| 5,557,804 | A | | 9/1996 | Ovortrup et al. | |
| 5,579,538 | A | | 12/1996 | Brunty | |
| 5,621,914 | A | | 4/1997 | Ramone et al. | |
| 5,625,896 | A | | 5/1997 | LaBarbera et al. | |
| 5,636,380 | A | | 6/1997 | Schindler et al. | |
| 5,669,080 | A | | 9/1997 | Culton | |
| 5,676,641 | A | | 10/1997 | Arensdorf et al. | |
| 5,678,245 | A | | 10/1997 | Rector et al. | |
| 5,689,836 | A | | 11/1997 | Free et al. | |
| 5,697,101 | A | | 12/1997 | Aldridge | |
| 5,701,611 | A | | 12/1997 | Rector et al. | |
| 5,713,082 | A | | 2/1998 | Bassette et al. | |
| 5,720,045 | A | | 2/1998 | Aldridge | |
| 5,781,935 | A | | 7/1998 | Bassett et al. | |
| 5,792,714 | A | | 8/1998 | Schindler et al. | |
| 5,806,088 | A | | 9/1998 | Zide et al. | |
| 5,840,397 | A | | 11/1998 | Landi et al. | |
| 5,881,395 | A | | 3/1999 | Donzis | |
| 5,920,915 | A | | 7/1999 | Bainbridge et al. | |
| 5,974,592 | A | | 11/1999 | Tabrizi | |
| 5,987,654 | A | | 11/1999 | Chartrand | |
| 6,006,363 | A | | 12/1999 | Karlin | |
| 6,009,565 | A | * | 1/2000 | Carrington | 2/455 |
| 6,023,789 | A | | 2/2000 | Wilson et al. | |
| 6,032,300 | A | | 3/2000 | Bainbridge et al. | |

6,041,441 A 3/2000 Counts et al.
D423,188 S 4/2000 Raffali
6,067,665 A 5/2000 DePalma et al.
6,074,274 A 6/2000 Pyatt et al.
6,093,468 A 7/2000 Toms et al.
6,098,209 A 8/2000 Bainbridge et al.
6,145,132 A 11/2000 Towner
6,161,222 A 12/2000 Strickland et al.
6,182,297 B1 * 2/2001 Duren et al. ..... 2/228
6,247,188 B1 6/2001 Béland
D445,724 S 7/2001 Kung
6,295,654 B1 10/2001 Farrell
6,301,722 B1 10/2001 Nickerson et al.
6,336,220 B1 1/2002 Sacks et al.
6,363,538 B1 4/2002 Davis
D456,995 S 5/2002 Baker
6,401,250 B1 6/2002 McNabb
6,408,446 B1 6/2002 Carrington
6,430,752 B1 8/2002 Bay
6,446,270 B1 9/2002 Durr
6,484,325 B1 11/2002 Lazarus et al.
6,532,599 B1 * 3/2003 Dugan ..... 2/228
6,553,579 B1 4/2003 Gillen et al.
6,623,835 B2 9/2003 Chang
D480,989 S 10/2003 Modolo
6,629,945 B1 10/2003 Stromgren
6,654,960 B2 12/2003 Cho
6,656,570 B1 12/2003 Fels et al.
D486,093 S 2/2004 Tobergte
6,745,400 B1 6/2004 Paciorkowski
6,748,601 B2 6/2004 LaShoto et al.
6,845,522 B2 1/2005 Béland
6,880,269 B2 4/2005 Falone et al.
6,880,347 B1 4/2005 Stam
6,918,140 B1 7/2005 Cooper
6,934,971 B2 8/2005 Ide et al.
6,971,123 B2 12/2005 Weaver
D525,765 S 8/2006 Arensdorf
7,168,104 B2 1/2007 Tobergte
D543,488 S 5/2007 Tobergte
7,389,547 B1 6/2008 Wiens
7,487,557 B2 * 2/2009 Bellfy ..... 2/465
7,506,384 B2 3/2009 Ide et al.
7,578,009 B1 * 8/2009 Boston ..... 2/405
7,716,755 B1 * 5/2010 Wiens ..... 2/466
2003/0167557 A1 * 9/2003 LaShoto et al. ..... 2/228
2004/0128748 A1 7/2004 Monica
2005/0229293 A1 10/2005 Miller
2007/0118979 A1 5/2007 Tobergte
2010/0024105 A1 * 2/2010 Sims ..... 2/466

* cited by examiner

Fig. 13
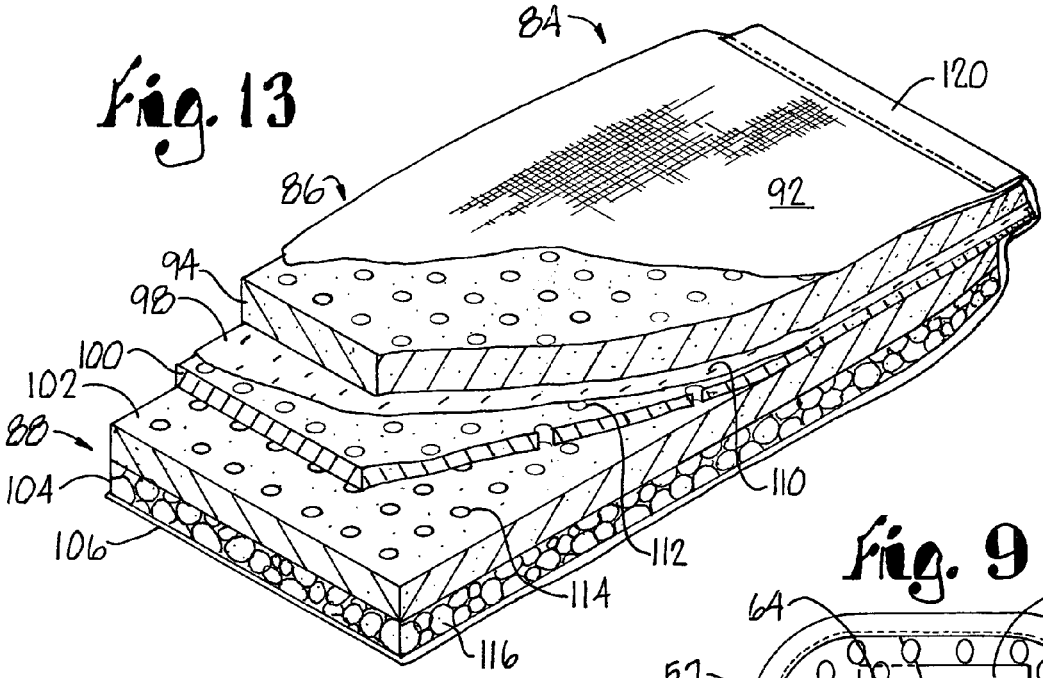
Fig. 9
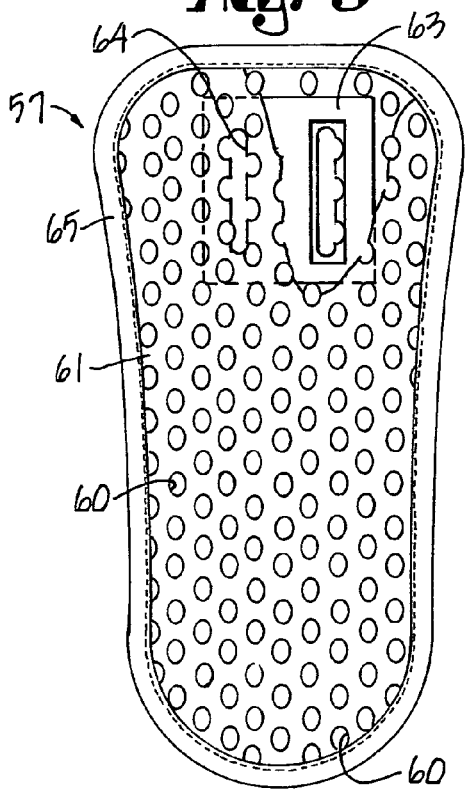
Fig. 8
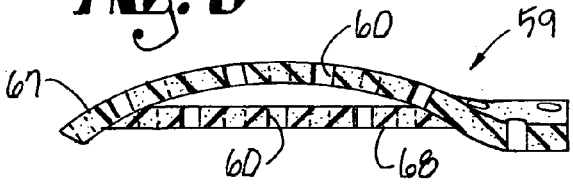
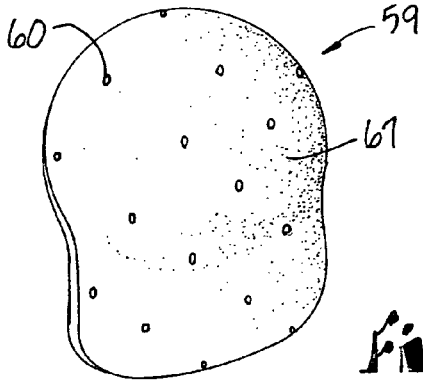
Fig. 7

ATHLETIC PROTECTIVE PADDING

CROSS-REFERENCE TO RELATED APPLICATIONS

The present application is a continuation-in-part application of Ser. No. 11/059,769, filed Feb. 17, 2005 now abandoned which is hereby incorporated into the present application by reference.

FIELD OF THE INVENTION

This invention related to improvements in athletic protective gear that is provided with lightweight, moisture wicking protective pads. In particular, the athletic protective gear in provided with breathable padding.

BACKGROUND OF THE INVENTION

Athletic protective pads, such as shoulder pads, rib protectors, hip pads, thigh pads, tail pads and so forth, are commonly worn by athletes in a variety of sports in which body contact with either another participant or a piece of equipment used in the sport presents the risk of injury. These types of protective pads have long been known and used by athletes in contact sports, such as football and hockey.

Compression wear, especially pants, has become widely used and accepted for active individuals and athletes engaged in sports and physical activity ranging from bicycling to football. The basic function of compression pants and compression shorts is to serve as an athletic girdle and support for muscles of the abdomen, lower back and thighs. This is accomplished through the use of a stretch fabric which is placed in tension as the part is pulled into position on the wearer's body. In sports such as football and baseball the shorts can be provided with internal pockets for receiving and holding protective pads. Hip, tailbone and thigh pockets may be provided on a fully-pocketed knee-length garment in order to provide maximum protection against impact. Alternatively, some or all of the protective pads may be sewn in permanently. Compression pants may additionally provide knee pads.

Sports such as football, baseball and hockey have long used protective helmets to provide head protection. The helmets include internal padding material for absorbing and cushioning impact.

These and other types of padding typically do not allow body heat to be released from the body. Thus, typical padding is very warm when worn by an athlete. This can decrease the athlete's level of performance and in extreme cases it can even be a cause of heat stroke. Furthermore, this padding typically is not breathable. The padding does not allow perspiration to be wicked away from the athlete's body. It is desirable for the padding to transfer heat and moisture away from the wearer.

BRIEF DESCRIPTION OF THE DRAWINGS

FIG. 7 is a perspective view of a knee pad used with compression pants in accordance with the present invention.

FIG. 8 is a cross-section of the knee pad of FIG. 7.

FIG. 9 is an enlarged top view of a tail pad used with compression pants in accordance with the present invention, broken away to show the inner plastic layer.

FIG. 13 is a cross-sectional view taken along line 13-13 of FIG. 12 showing the breathable padding, with the outer plastic removed for clarity.

DETAILED DESCRIPTION

Figure 1:
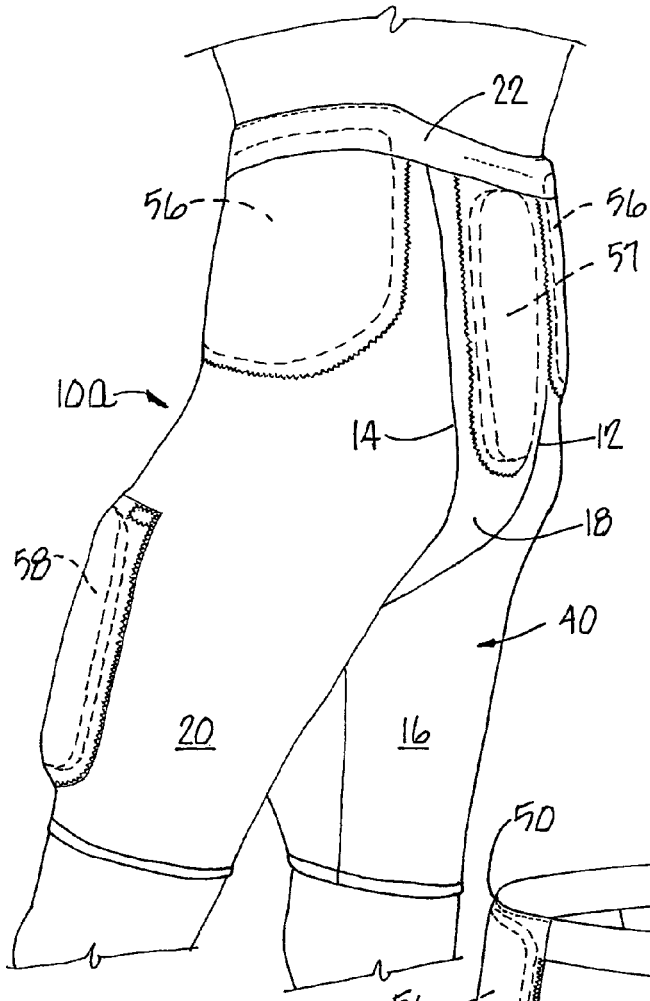
FIG. 1 is a perspective view of compression pants shown as worn by a user, the sport pants having breathable hip, thigh and tail protective pads in accordance with the present invention.
Figure 2:
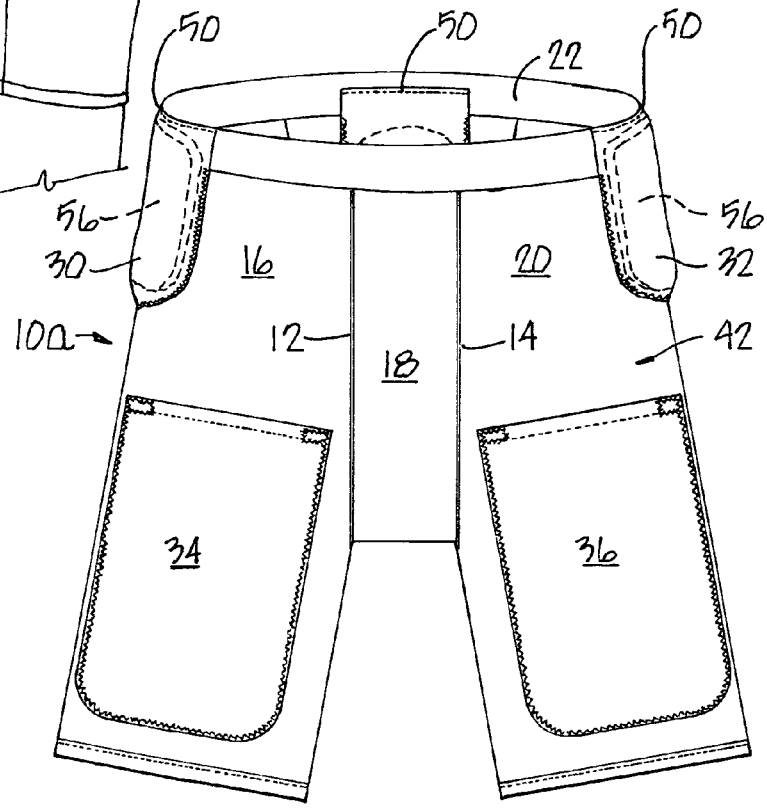
FIG. 2 is a front view of the compression pants of FIG. 1 turned inside out and with the thigh pads removed from within the thigh panels.
Figure 3:
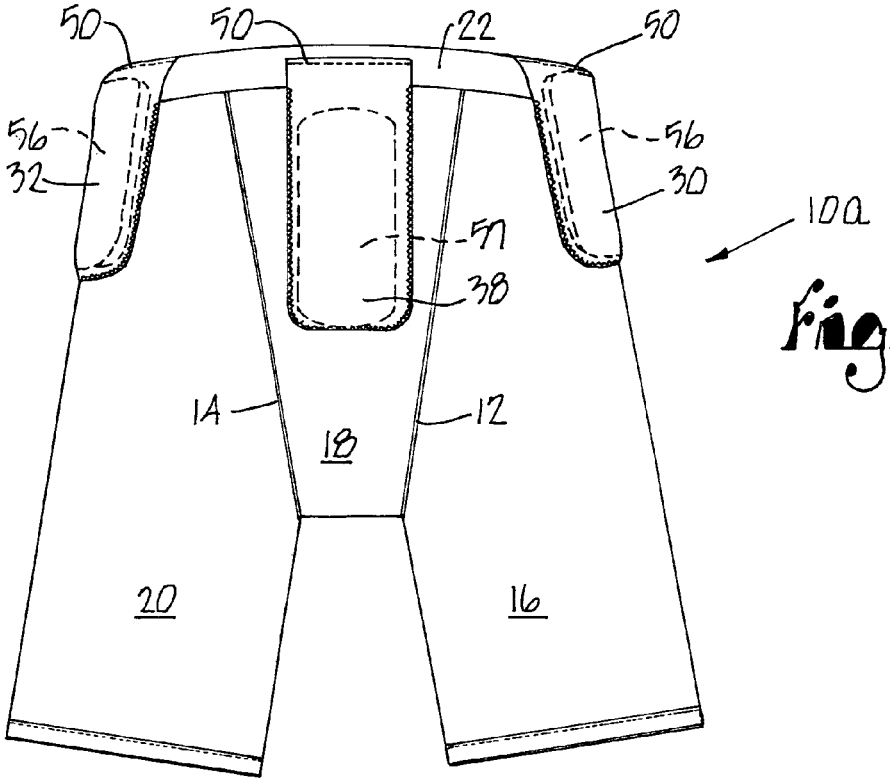
FIG. 3 is a rear view of the compression pants of FIG. 1 turned inside out.
Figure 6:
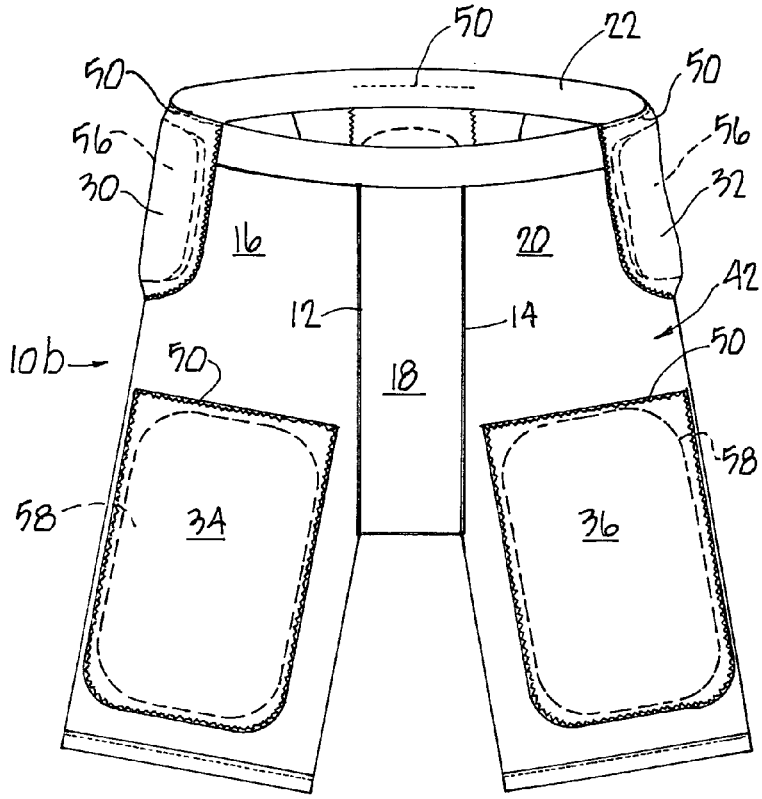
FIG. 6 is a front view of a second embodiment of compression pants turned inside out, with breathable hip, thigh and tail pads in accordance with the present invention.
Figure 11:
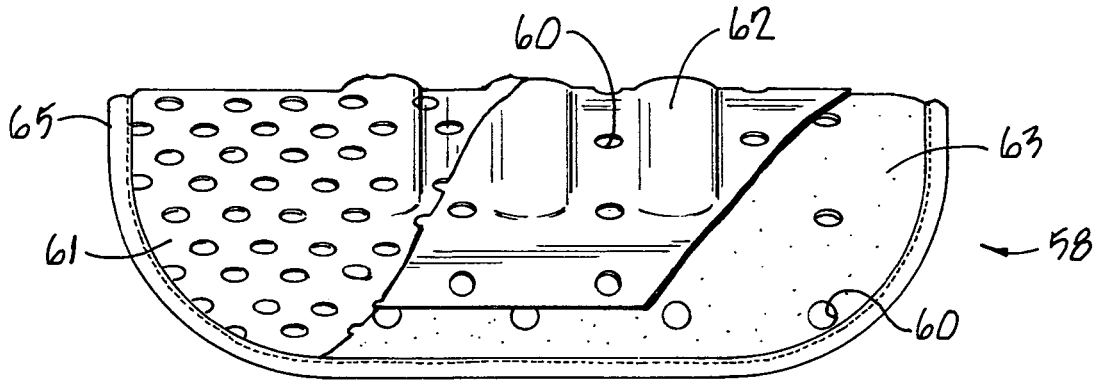
FIG. 11 is a partial top view of the thigh pad of FIG. 10 broken away to show the inner plastic layer.
Figure 10:
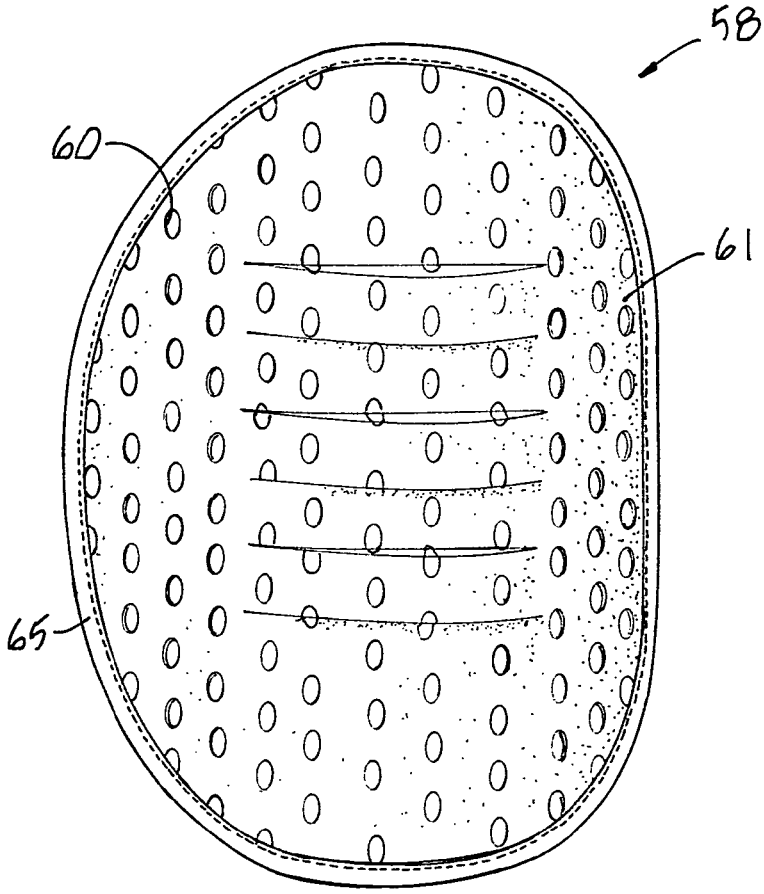
FIG. 10 is an enlarged perspective view of a thigh pad used with compression pants in accordance with the present invention.

Referring initially to FIGS. 1-3 and 6, the protective padding of the present invention is shown as used with a compression sport pant. More specifically, the pant illustrated in FIGS. 1-3 is a knee-length football girdle 10*a* and the pant illustrated in FIG. 6 is a baseball sliding pant 10*b*. The pants 10*a* and 10*b* are very similar; however, differences between the pants 10*a* and 10*b* will be made clear throughout the description. FIG. 1 shows the exterior or outer surface 40 of the pants 10*a* and FIGS. 2, 3 and 6 show the interior or inner surface 42 of the pants 10*a* and 10*b* (with the pants 10*a* and 10*b* turned inside-out).

The sport pants 10*a* and 10*b* have three body sections stitched together at main seams 12 and 14, a right pelvis and leg section 16, a crotch section 18 and a left pelvis and leg section 20. The main seams 12 and 14 extend from the front of a waistband 22 down under the crotch and up to the back of the waistband 22 as may be appreciated by comparing FIGS. 2 and 6 with FIGS. 1 and 3.

Each of the pants 10*a* and 10*b* are provided with five pad panels, namely, identical right and left hip pad panels 30 and 32, identical right and left thigh pad panels 34 and 36 and a tail pad panel 38. The pad panels 30, 32, 34, 36 and 38 are secured by stitching to the inner surface 42 of the pants 10*a* and 10*b*, as shown most clearly in FIGS. 2, 3 and 6.

The three body sections 16, 18 and 20 and the pad panels 30, 32, 34, 36 and 38 are formed of a highly resilient, breathable fabric, preferably a blend of 75 percent nylon and 25 percent Lycra® (DuPont registered trademark) having a rating of approximately 280 denier. But the compression pants may be formed of any suitable compression material.

The pad panels 30, 32, 34, 36 and 38 are stitched and secured to the body sections 16, 18 and 20 substantially as the pocket panels shown and described in detail in U.S. Pat. No. 5,161,257 which is hereby incorporated herein by reference. However, unlike the panels in the '257 patent, as shown and described herein, most of the pad panels 30, 32, 34, 36 and 38 do not present pockets. More specifically, pad panels 30, 32 and 38 of compression pant 10*a* and pad panels 30, 32, 34, 36 and 38 of compression pant 10*b* do not present pockets. Each hip panel 30 and 32 is secured along its top edge by stitching 50 immediately adjacent the top edge of the waistband 22. The top edge of the tail pad panel 38 is secured by stitching 50 to the waistband 22. The top edge of each thigh panel 34, 36 of compression short 10*b* is secured by stitching 50 to the corresponding right or left body section 16 or 20.

Thigh panels 34 and 36 of the football girdle 10*a* do present pockets. Of course, the pad panels 30, 32, 34, 36 and 38 can be secured to the pants 10*a* and 10*b* as pockets or closed across the top edge, as desired. If the panels 30, 32, 34, 36 or 38 are secured to the pants 10*a* or 10*b* to form pockets, the athletic pad is selectively removable from the pants 10*a* or 10*b*. Otherwise, the pad is not removable from the pants 10*a* or 10*b*.

Whether, the panels 30, 32, 34, 36 and 38 form pockets or are secured across the top edge, they cooperate with the corresponding body section 16, 18 or 20 of the pants 10*a* or 10*b* to sandwich an athletic pad 56, 57, 58 or 59 therebetween. The athletic pads can take any shape as desired.

As shown, the athletic pads 56, 57, 58 and 59 are formed of closed cell EVA foam. The pads 56, 57, 58 and 59 have spaced apart perforations 60 extending therethrough, as seen in FIGS. 5, 7, 8, 9, 10 and 11. The combination of the breathable fabric used for the body sections 16, 18 and 20 and the pad panels 30, 32, 34, 36 and 38 of the sport pants 10*a* and 10*b* and the perforated EVA foam for the pads 56, 57, 58 and 59 allows the sport pants 10*a* and 10*b* to ventilate or wick moisture away from the wearer, making the pants 10*a* and 10*b* drier and cooler to wear. Furthermore, the pants 10*a* and 10*b* thus do not absorb moisture and become heavy. Alternatively, the pads 56, 57, 58 and 59 could be formed of Brock™ foam, discussed in more detail below, or any other kind of breathable or perforated foam.

Figure 4:
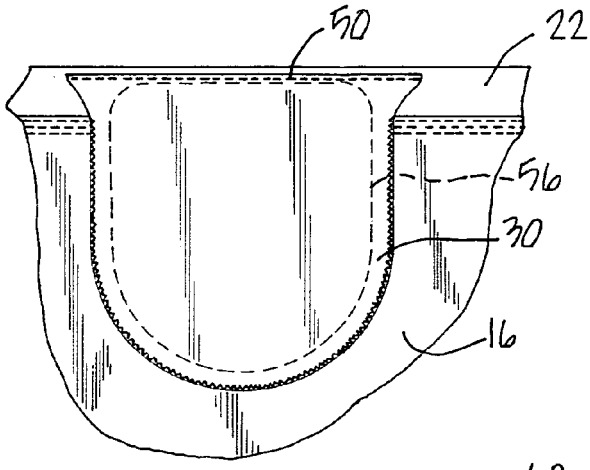
FIG. 4 is an enlarged detail of the right hip panel and pad of the compression pants of FIG. 1.
Figure 5:
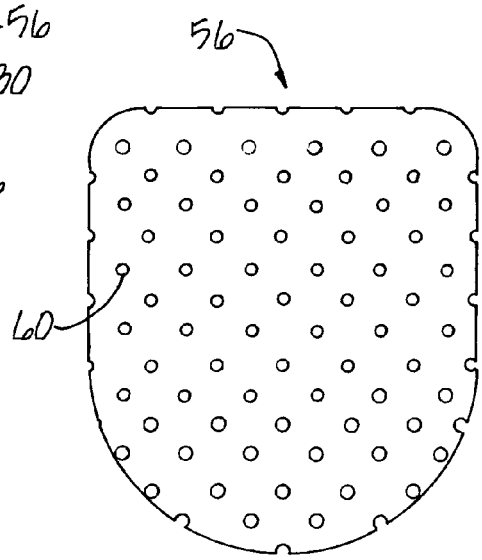
FIG. 5 is an enlarged top view of a hip pad of the compression pants of FIG. 1.

A hip pad 56 is shown in detail in FIG. 5. It has a tear drop shape and substantially conforms to the shape of the hip panel 30. It is shown secured to the right body section 16 by the hip panel 30 in FIG. 4. Hip pads 56 are also shown with pants 10*a* and 10*b* in FIGS. 1, 2, 3 and 6 secured high on the waistband 22 to protect the wearer's iliac crest. This helps prevent hip pointer injuries. Preferably, the hip panels 30 and 32 and the hip pads 56 are positioned within ⅛" of the top edge of the waistband 22.

A tail pad 57 is shown in detail in FIG. 9. It has an elongated shape to substantially conform to the shape of panel 38. The tail pad 57 is shown secured between the panel 38 and the body section 18 of the pants 10*a* and 10*b* in FIGS. 1 and 3. The tail pad 57 includes a top and bottom layer of perforated closed cell foam 61 and 62 which sandwich a middle reinforcing plastic layer 63 extending around strap slots 64. The plastic layer 63 is held in place between the foam layers 61 and 62 with any suitable adhesive. The outer edges of the foam layers 61 and 62 are stitched together, preferably through fabric edging 65.

Figure 14:
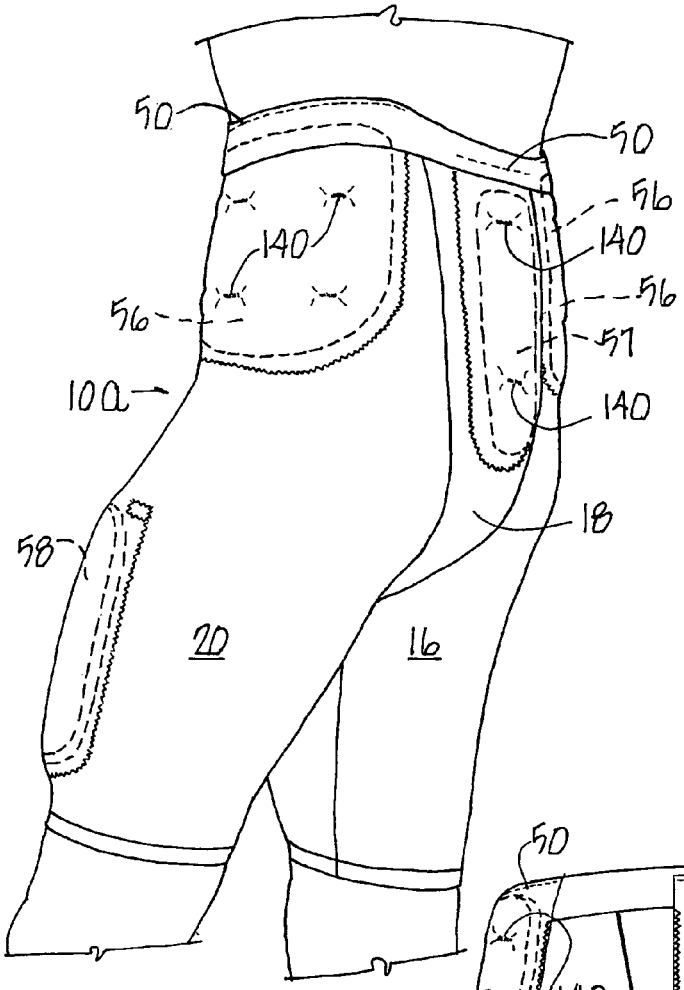
FIG. 14 is a perspective view of an alternate embodiment of pants shown as worn by a user in accordance with the present invention.
Figure 15:
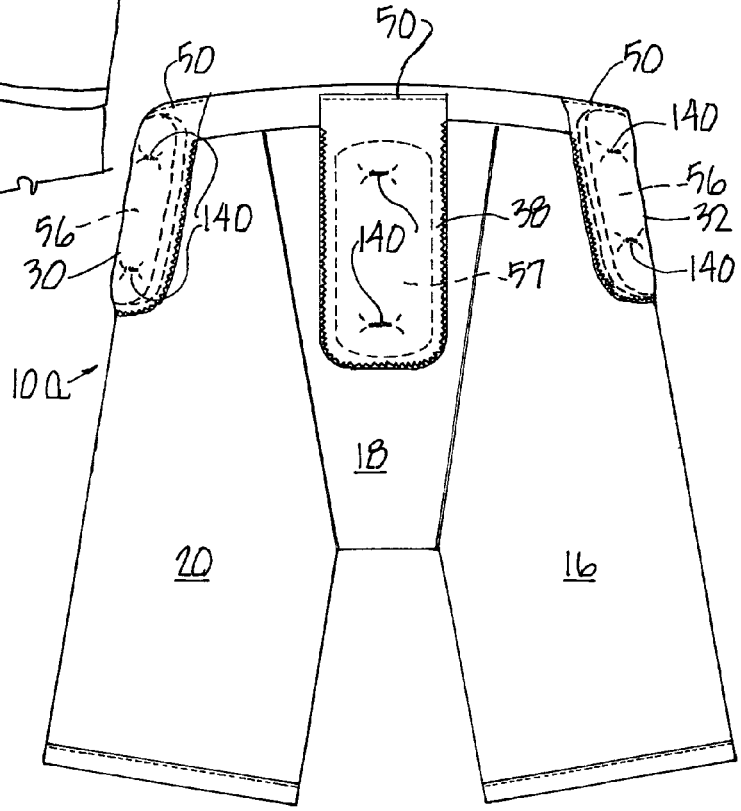
FIG. 15 is a rear view of the compression pants of FIG. 14 turned inside out.

As shown in FIGS. 2, 3, 6, 14 and 15, the pads 56, 57 and 58 are permanently secured in the desired protective position between their respective panel 30, 32, 34, 36 or 38 and the garment 10*a* or 10*b* by stitching 50. Furthermore, as shown in FIGS. 14 and 15 bar tack stitching 140 secures the pads 56, 57 and 58 in position. Specifically, the stitching 50 and the bar tack stitching 140 hold pads 56 in place overlapping the waistband 22 of the garment 10*a* and 10*b*. As shown, four spaced apart bar tacks 140 are used to secure the hip pads 56 and two spaced apart bar tacks 140 secure the tail pad 57 in place. However, one bar tack 140 per pad may be sufficient. Any number of bar tacks 140 may be used as desired. The bar tacks 140 are preferably approximately ⅝" in length, but the length may be varied as desired. The bar tacks 140 preferably extend through the panel 30, 32 or 38, the respective pad 56 or 57 (or 58, not shown) and the garment 10*a* or 10*b*.

FIGS. 1 and 6 show larger, substantially rectangular shaped thigh pads 58 secured by panels 34 and 36. FIG. 2 includes panels 34 and 36 which present pockets into which thigh pads 58 can be inserted and removed, as desired. A thigh pad 58 is shown in detail in FIGS. 10 and 11. Similar to the tail pad 57, the thigh pads 58 include a top and bottom layer of perforated closed cell foam 61 and 62 which sandwich a middle reinforcing plastic layer 63. The plastic layer 63 is held in place between the foam layers 61 and 62 with any suitable adhesive. The outer edge of the foam layers 61 and 62 are stitched together, preferably through fabric edging 65. The perforations 60 extend through all three layers 61, 62 and 63.

FIG. 7 shows a knee pad 59 that may be used with a longer version of the pants 10*a* and 10*b* that extend over the wearer's knees. The knee pad 59 includes a top, cupped layer 67 and a flat base layer 68, as shown in FIG. 8. Each layer 67 and 68 has the perforations 60 extending therethrough.

Figure 12:
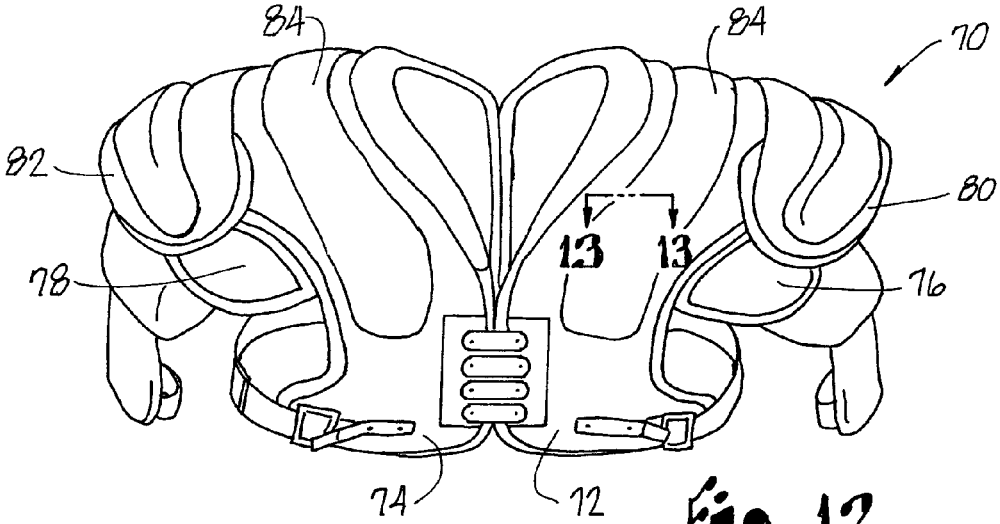
FIG. 12 is a perspective view of football shoulder pads having breathable protective padding in accordance with the present invention.

Protective padding, such as that described above with respect to compression sport pants 10*a* and 10*b* can also be used in connection with other athletic gear. For instance, this type of breathable padding could be used in protective helmets, as used in football or baseball. Such padding would wick moisture away from the wearer's head. If the padding is spaced or suspended from the helmet's hard outer shell, the breathability would be enhanced. Additionally, as another example, football shoulder pads 70, such as those shown in FIG. 12, can incorporate the breathable padding.

The shoulder pads 70 include left and right torso halves 72 and 74, left and right deltoid pads 76 and 78 and left and right shoulder pads 80 and 82. A rigid plastic outer area 84 typically extends partially over the exterior of each torso half 72 and 74 to provide stability to the shoulders. The padding construction 84 used in the football shoulder pads 70 is best shown in FIG. 13. The padding construction 84 presents an outer pad 86 and an inner pad 88.

As shown and described herein, the outer and inner pads 86 and 88 include a combination of breathable fabrics, closed cell EVA foam and Brock™ foam. This combination of materials is used to provide ease in manufacture, cost efficiency and comfort to the wearer. The combination of breathable fabrics, perforated closed cell foam and Brock™ foam also allows the football shoulder padding to ventilate or allow heat and moisture transfer therethrough while still providing adequate protection. However, it should be understood that the padding could be composed of a single thicker layer of EVA foam or of Brock™ foam or any other perforated or otherwise breathable foam. Furthermore, the fabric layers could be composed of any suitable breathable fabric.

The padding construction 84 includes an outer fabric layer 92 and a foam layer 94, which presents the outer pad 86. The outer fabric layer 92 is preferably a breathable nylon mesh material, and the foam layer 94 is preferably EVA closed cell foam, with a 6 mm thickness. The foam layer 94 includes spaced apart perforations 96. The outer fabric layer 92 is laminated over the outer surface of the foam layer 94. The lamination does not substantially block or clog the perforations 96. The outer fabric layer 92 and the foam layer 94 are substantially the same width, a first width.

The padding construction 84 further includes an intermediate reinforcing fabric layer 98, a second foam layer 100, a third foam layer 102, a fourth foam layer 104 and an inner fabric layer 106, which presents the inner pad 88.

The intermediate fabric 98 has spaced apart openings 110 therethrough. The second and third foam layers 100 and 102 are preferably closed cell EVA foam, with the second layer 100 being thinner relative to the third layer 102. Specifically, the second foam layer 100 preferably has a thickness of 4 mm and the third foam layer 102 preferably has a thickness of 8 mm. Each of layers 100 and 102 have spaced apart perforations 112 and 114, respectively. Preferably, the layer 102 is formed of C3000 EVA type foam, which is softer and lighter than some other EVA foams.

The fourth foam layer 104 is formed of closed cell foam beads 116 fused together where the individual beads 116 meet. One such foam is Brock™ foam which is disclosed in U.S. Pat. Nos. 5,920,915 and 6,032,300. These patents are hereby incorporated herein by reference. This foam circulates air in three dimensions. As the body sweats, the sweat coats the beads which actually accelerates evaporation, body cooling and drying. Upon impact, each bead tries to separate the adjacent beads sideways, deflecting the energy away from the body and thereby absorbing more impact than foams of comparable weight and flexibility. This fourth foam 104 layer preferably has a thickness of 5 mm. The inner fabric layer 106 is also breathable and it extends across or over the exposed surface of the fourth foam layer 104.

Of the inner pad 88, the intermediate fabric layer 98 and foam layers 100, 102 and 104 are laminated together. This lamination does not block or clog a substantial portion of the layers' perforations 110, 112 and 114.

The intermediate fabric layer 98 and the second foam layer 100 have the first width, or are substantially the same width as the outer foam pad 86. The third and fourth foam layers 102 and 104 have a second width, narrower than the first width. The inner fabric layer 106 has substantially the first width. Thus, the inner fabric layer 106 is secured to the intermediate fabric layer 98 and foam layers 100, 102 and 104 by stitching the side edges of the inner fabric layer 106 to the sides edges of the intermediate fabric layer 98 and the second foam layer 100 to form the inner pad 88.

The outer and inner pads 86 and 88 are secured together by stitching the side edges of the inner pad 88, (i.e., the side edges of intermediate fabric layer 98, second foam layer 100 and inner fabric layer 106) to the side edges of the outer pad 86 (i.e., the side edges of the outer fabric 92 and foam layer 94) through fabric edging 120. Thus, no stitching extends into the third or fourth layers of foam 102 and 104 of the inner pad 88. Fabric edging 120 extends around the periphery or outer edge of the padding construction 84.

It is to be understood that while certain forms of this invention have been illustrated and described, it is not limited thereto except insofar as such limitations are included in the following claims and allowable equivalents thereof. More specifically, this athletic protective padding construction could be used in protective helmets and in connection with padding for any sport.

Having thus described the invention, what is claimed as new and desired to be secured by Letters Patent is as follows:

1. A compression sport pant, comprising:

a garment of resilient, breathable fabric having right and left pelvic leg regions and a crotch region shaped to compliment the pelvic and leg region of a wearer and presenting an upper edge;

a waistband having an upper edge and a lower edge, said lower edge of said waistband being joined to said upper edge of said garment along a seam;

a pocket layer of resilient, breathable fabric anchored to said garment and said waistband adjacent said top edge thereof to present a cavity between said garment and said pocket layer;

a foam pad received in said cavity and extending over said waistband seam, having a layer of closed cell foam with spaced apart perforations therethrough, thereby wicking moisture away from the wearer; and means for permanently securing said foam pad in said cavity in a desired position overlapping said waistband seam which includes a length of stitching that extends through said pocket layer, said foam pad and said garment.

2. A compression sport pant as claimed in claim 1 wherein said means for securing further includes a second length of stitching extending across a top edge of said pocket layer and through said waistband.

3. A compression sport pant as claimed in claim 1 wherein said means for securing includes a plurality of said length of stitching.

* * * * *